US009663939B2

(12) United States Patent
Seidel

(10) Patent No.: US 9,663,939 B2
(45) Date of Patent: May 30, 2017

(54) FOUNDATION FOR A WIND TURBINE

(71) Applicant: SENVION SE, Hamburg (DE)

(72) Inventor: Marc Seidel, Osnabrück (DE)

(73) Assignee: Senvion SE, Hamburg (DE)

( * ) Notice: Subject to any disclaimer, the term of this patent is extended or adjusted under 35 U.S.C. 154(b) by 0 days.

(21) Appl. No.: 14/417,606

(22) PCT Filed: Jun. 19, 2013

(86) PCT No.: PCT/EP2013/001811
§ 371 (c)(1),
(2) Date: Jan. 27, 2015

(87) PCT Pub. No.: WO2014/015927
PCT Pub. Date: Jan. 30, 2014

(65) Prior Publication Data

US 2015/0218796 A1 Aug. 6, 2015

(30) Foreign Application Priority Data

Jul. 27, 2012 (DE) ..... 10 2012 014 828

(51) Int. Cl.
*E04B 1/41* (2006.01)
*E02D 27/42* (2006.01)
(Continued)

(52) U.S. Cl.
CPC ..... *E04B 1/4114* (2013.01); *E02D 27/42* (2013.01); *E02D 27/425* (2013.01); *E04B 1/19* (2013.01); *E04H 12/22* (2013.01); *E04H 12/34* (2013.01)

(58) Field of Classification Search
CPC ..... E02D 27/425; E02D 27/42; E02D 27/12; E02D 27/14; E02D 27/16; E02D 27/52;
(Continued)

(56) References Cited

U.S. PATENT DOCUMENTS 3,125,858 A * 3/1964 Baittinger ..... E02D 5/523 138/122
3,134,235 A * 5/1964 Parker ..... E02B 17/0004 405/228
(Continued)

FOREIGN PATENT DOCUMENTS

DE EP 2067913 A2 * 6/2009 ..... E02B 17/0004
DE EP 2067914 A2 * 6/2009 ..... E02B 17/0004
(Continued)

OTHER PUBLICATIONS

English Translation of the International Preliminary Report on Patentability dated Jan. 27, 2015 in corresponding International Patent Application No. PCT/EP2013/001811.

*Primary Examiner* — Babajide Demuren
(74) *Attorney, Agent, or Firm* — Rankin, Hill & Clark LLP

(57) ABSTRACT

An openwork load-bearing structure for a wind turbine, in particular a lattice-tower structure for a wind turbine, in particular a foundation structure for a wind turbine, in particular for anchoring an offshore wind turbine in the ground via driven foundation piles, wherein the openwork load-bearing structure has primary structures, via which loads which occur in the load-bearing structure as a result of the wind turbine are dissipated, and secondary structures, which perform functional, rather than load-dissipating, tasks, wherein the secondary structures are arranged on the primary structures and are connected integrally thereto, and wherein the integral connection between the primary and the secondary structures is in the form of a connecting layer arranged therebetween. Also, a method for producing a lattice-tower structure for a wind turbine, in particular a
(Continued)

foundation structure for a wind turbine, in particular for anchoring an offshore wind turbine in the ground via foundation piles.

18 Claims, 6 Drawing Sheets

(51) Int. Cl.
*E04B 1/19* (2006.01)
*E04H 12/22* (2006.01)
*E04H 12/34* (2006.01)

(58) Field of Classification Search
CPC ..... E02D 17/0004; E02D 17/0091; F03D 11/045; F05B 2240/95; F05B 2240/9121; F05B 2240/97; Y02E 10/727; Y02E 10/728; E04B 1/4114; E04B 1/19; E04H 12/22; E04H 12/34
USPC ..... 52/298; 405/228, 223.1, 222, 244, 230, 405/231, 251, 255, 227
See application file for complete search history.

(56) References Cited

U.S. PATENT DOCUMENTS 3,512,811 A * 5/1970 Moody ..... E02B 17/0008 285/288.1
3,838,575 A * 10/1974 Clark ..... E02B 17/0008 405/227
4,422,805 A * 12/1983 Sweatman ..... E02B 17/0008 405/222
4,571,123 A * 2/1986 Chandra ..... E02B 17/00 405/212
4,669,918 A * 6/1987 Riles ..... E02B 17/00 405/203
4,679,964 A * 7/1987 Blandford ..... E02B 17/027 166/356
4,721,416 A * 1/1988 Gracia ..... E02B 17/00 405/225
5,122,010 A * 6/1992 Burguieres, Jr. ..... E02B 17/027 405/204
5,244,312 A * 9/1993 Wybro ..... E02B 17/00 166/338
8,322,093 B2 * 12/2012 Zavitz ..... E04H 12/12 405/250
2006/0222465 A1 * 10/2006 Seidel ..... E02B 17/00 405/224
2007/0243063 A1 * 10/2007 Schellstede ..... E02D 27/42 416/10
2008/0028715 A1 * 2/2008 Foss ..... F03D 11/045 52/651.01
2010/0031589 A1 * 2/2010 Fernald ..... E02D 27/42 52/173.1
2013/0149039 A1 * 6/2013 Haugsoen ..... E02B 17/0008 405/223

FOREIGN PATENT DOCUMENTS

DE EP 2067915 A2 * 6/2009 ..... E02B 17/0004
DE 102010026117 A1 * 3/2011 ..... E02D 27/42
DE 202011101599 U1 9/2011
DE 102012007425 A1 * 10/2013 ..... F03D 11/04
DE 202012009681 U1 * 1/2014 ..... E02B 17/027
DE EP 2698476 A1 * 2/2014 ..... E02D 27/42
DE 102012020871 A1 * 4/2014 ..... E02D 27/042
ES EP 2662495 A1 * 11/2013 ..... E02B 17/0008
JP 01033313 A * 2/1989
NL EP 2495370 A1 * 9/2012 ..... E02B 17/027
NO EP 2374992 A1 * 10/2011 ..... F16L 3/24
WO 2011/010937 A1 1/2011

* cited by examiner

FOUNDATION FOR A WIND TURBINE

BACKGROUND OF INVENTION

Field of Invention

The present invention relates to an openwork load-bearing structure, in particular a lattice tower structure for a wind turbine. In particular, the invention relates to a foundation structure, which is embodied as an openwork load-bearing structure, in particular as a lattice tower structure, and which is anchored to the ground, for example, as an offshore foundation structure by means of driven foundation piles, in particular by means pre-driven hollow piles. Furthermore, the present invention relates to a method for producing an openwork load-bearing structure, in particular a lattice tower structure.

Brief Description of Related Art

Openwork load-bearing structures include, for example, tripods, tripiles or lattice tower structures. The invention will be discussed using such lattice tower structures as an example, without this being intended to be limiting. Lattice tower structures in the context of wind turbines are well known, for example, as lattice towers for wind turbines as an alternative to tubular steel towers. Also known are tower lattice structures as foundation structures, via which a structure is connected to the ground. Such known foundation structures, for example, consist of a lattice structure of corner posts and framework-like struts that are arranged between the corner posts. In other openwork load-bearing structures the term used is legs rather than corner posts. The anchoring to the ground, e.g. to the seabed, is carried out, for example, via driven foundation piles, for example embodied as hollow piles in order to be able to receive the lower ends of the corner posts. Then, grout is filled into the hollow piles to firmly connect the corner posts to the piles. In general, the corner post is extended at its free end using so-called jacket legs for the connection to the foundation piles. These jacket legs are positioned in such a way that in the vertical direction they stand in the foundation piles, while the corner posts are tilted with respect to the vertical direction. According to the terminology of the present application these jacket legs are part of the corner post and thus included in the term "corner post". Thus, connecting the corner posts with the piles can therefore also be connecting the jacket legs with the piles.

Generally, these known foundation structures are referred to as jacket foundations and are mainly used in the offshore area, that is the foundation structure is in the sea, and the hollow piles are anchored to the seabed. On the foundation structure, there may be arranged a tower structure, especially a wind turbine, for example, a wind turbine with a lattice or a tubular steel tower.

The aforementioned lattice tower structures consist of so-called primary and secondary structures. Primary structures are the parts of the lattice tower structure, which dissipate the loads as a result of the wind turbine. These loads include static loads, such as those resulting from the dead weight of the wind turbine, and dynamic loads, for example, those resulting from the rotation of the rotor and from prevailing winds. Primary structures include, for example, the corner posts and the struts connecting the corner posts and extending between the corner posts. Included are also nodes, for example, cast and welded nodes. By contrast, the secondary structures have no stability-related load-dissipating function, rather they are provided to perform functional tasks and thereby distribute any occurring loads (e.g., impact loads of service ships at the boat dock) to the primary structure. Secondary structures include, for example, J tubes, platforms and docks for the landing of boats, work platforms, or pile stoppers at the anchoring end regions of the corner posts, which limit in penetration depth of a corner post when inserted into a hollow pile that is driven or drilled in the seabed. This list is only illustrative and not exhaustive. Unlike in the case of primary structures, the failure of a secondary structure does not cause deterioration of the stability of the overall construction.

In known lattice tower structures the secondary structures are connected integrally with the primary structures wherein the material of the structures is changed metallurgically such as, for example, in the case of welding. For example, platforms are welded to the corner posts or to the struts. The disadvantage of welding joints is that a notch effect is produced by the change in the metallurgical structure, through which the fatigue strength of the structure is reduced. As a result, in particular, the primary structure must be size thicker in order to compensate for the reduction in fatigue strength, which increases the cost of the lattice tower structure.

It is the object of the present invention to provide in this regard an improved lattice tower structure or openwork load-bearing structure.

BRIEF SUMMARY OF THE INVENTION

The object is achieved with a lattice tower structure or with an openwork load-bearing structure as described herein. Advantageous alternative embodiments are also described herein.

The lattice tower structure or openwork load-bearing structure according to the invention is characterized in that the integral connection between the primary and the secondary structure is formed as a setting connecting layer that is arranged between the primary and secondary structure.

In the present invention no welding is required for establishing the connection between primary and secondary structures, rather the connection is made via a connecting layer. The connecting layer provides the advantage that no metallurgical changes are created in the material structure, and thus no notch effects occurs. Likewise, the fatigue strength, in particular of the load-dissipating primary structures, is not impaired. Advantageously, this means that compared to the prior art the primary structure and also the secondary structure may be sized lighter at least partially, and costs can be reduced accordingly.

According to an advantageous embodiment, the connecting layer may be an adhesive layer. Generally, adhesive joints have been known in steel construction. Suitable adhesive joints and adhesives are described, inter alia, in the article "*Kleben im Stahlbau*" in the journal Stahlbau 75 (2006), No. 10, pp. 834, authors: Markus Feldmann et al.

According to another embodiment of the invention (normal or high-strength) grout may be an alternative connecting device to an adhesive. Grout joints are generally known in the prior art, so that in this regard no further explanation is required.

Basically, primary and secondary structures can be connected integrally with one another, then, the adhesive or grout layer would be arranged directly between the two partners to be secured to one another. An advantageous embodiment of the invention provides, however, that the secondary structure is secured to a sleeve, in particular by welding, and in that the sleeve fits positively to the primary structure, wherein the connecting layer is formed between the sleeve and the primary structure.

Looking at it in a different way, one could view the sleeve as part of the secondary structure, which technically makes no difference. In this application, the chosen approach has been such that the sleeve is not part of the secondary structure, even if the sleeve and secondary structure are integrally formed. It is understood, that this is merely a chosen definition.

This embodiment according to the invention offers the advantage that the secondary structure need not be directly secured to the primary structure, which can be a problem, for example, when only small connecting surfaces are available. The sleeve may have a connecting surface of suitable size and outline, and the secondary structure, for example, can be welded to the sleeve. However, sleeve and secondary structure can also be connected in other ways or be made in one piece. A sleeve has the advantage that it can be produced in a variety of sizes and shapes, and that the loads occurring as a result of the secondary structure are dissipated via the sleeve and via the connecting layer to the primary structure without thereby structurally weakening the primary structure.

According to a further embodiment, the sleeve can be formed at least in two parts. This embodiment offers the advantage that the sleeve can be arranged to the primary structure in a simple manner. In case of tubular-shaped primary structures the sleeve can consist, for example, of two 180°-shells, which form a closed ring, optionally together with auxiliary shells. The shells can be connected by welding or bolting together, for example.

According to an embodiment of the invention it is also conceivable to form the sleeve as partial shell for not very heavily loaded connections. This embodiment has the advantage that the sleeve would enclose the primary structure only partially and can be installed quickly and easily.

Advantageously, the invention can be implemented when the openwork load-bearing structure or the lattice tower structure is a foundation structure, the primary structure is a corner post or leg, and the secondary structure is a pile stopper for the depth limitation of the corner post or leg during insertion into pre-driven hollow piles. In this context, pile stoppers refers to the German term "Auflager". Particularly advantageously, the implementation of the securing according to the invention by means of a connecting layer is less problematic than the welding and offers practical advantages with respect to construction. In the prior art, the pile stopper is welded to the corner post far ahead of the establishment of the foundation structure, namely ashore in a workshop. The reason for this is that producing a welded joint is time-consuming, and the welded joint then still must be tested in terms of its strength and may have to be certified. This leads to the disadvantage that the arrangement of the pile stoppers at the corner posts or legs is not very close to the pile heights actually encountered in the construction of the foundation which can be determined only after measurement of the piles, e.g., after driving. This is a known problem, and in the prior art this problem is addressed by setting lining plates between the upper edges of the pile and the pile stoppers to adjust the height. WO2011/010937 A1, inter alia, deals with this problem of adjusting the height.

In contrast, the embodiment of the invention offers the advantage that the connection between the corner post and the pile stopper can be established following the measurement of the pre-driven piles either on site or shortly before loading onshore, so that the arrangement of the pile stopper at the corner post can be adapted to the actual pile height on site. This is possible because both an adhesive and a grout connection can be established in a relatively short time and in consistently good quality.

One requirement for offshore wind turbines is that they must have sufficient grounding. In the prior art, as a result, when using height compensation plates, especially those with elastic properties, there was no electrical contact between the corner post and the foundation pile which otherwise would have been established by the pile stopper resting on the pile so that an electrical connection had to be established subsequently, for example, by subsequently attaching a conductor between pile stopper and foundation pile. These works had to be carried out by divers. The subsequent arrangement of such electrical conductor is no longer required in the embodiment according to the invention, since the pile stopper advantageously rests directly on the pile, whereby electrical conduction is established. Due to the connecting layer between pile stopper and corner post, which generally is not conductive, possibly an electrical connection between the corner post and the pile stopper has to be established, which can be easily performed during attachment of the pile stopper, and thus is feasible without the cumbersome and risky use of divers.

After the corner posts are grouted into the foundation piles, according to the prior art, no more load-dissipation occurs through the pile stoppers, rather only via the grout connection of the corner posts in the foundation piles. It may happen, however, that at least in part loads are transferred via the pile stoppers. This is problematic because of the notch effect of welded joints. To avoid such problems, the pile stoppers are therefore often removed during dives when the grout has cured in the foundation piles.

In contrast, the embodiment according to the invention has the advantage that no notch effect occurs due to the type of connection according to the invention. Accordingly, the pile stoppers would not have to be removed, because a partial load transfer is not problematic here. Was there a failure of the connection according to the invention after the construction of the foundation, it would even be the target case since then a load dissipation of 100% was occurring via the grout connection.

According to an advantageous embodiment of the invention, the pile stopper is constructed of a bottom pile stopper ring plate with a central through hole for the corner post or the leg, a cylindrical extension surrounding the through hole and arranged on the inside of the ring of the pile stopper ring plate, and several reinforcing fins which are arranged extending radially outwardly, in particular delta-shaped, between pile stopper ring plate and extension along the perimeter of the extension which is arranged substantially perpendicular on the pile stopper ring plate, wherein the pile stopper ring plate is sized radially surmounting the foundation pile at a corner post or leg inserted in a foundation pile. This structure is characterized by being material-saving and yet stable. Here, according to a further embodiment of the invention, it is advantageous that the pile stopper is formed at least in two parts, as a split pile stopper at a corner post or leg is easier to install and easier to handle.

A further advantageous embodiment of the invention provides that spacers are arranged in the opening of the pile stopper via which the corner post or leg in the opening is kept at a distance from the pile stopper. This ensures that a sufficient annular gap is present for the introduction of the connecting layer.

A further advantageous embodiment of the invention provides that the area of the connecting layer in particular is provided with corrosion protection, for example with an anti-corrosion paint or coating.

According to another embodiment of the invention, a secondary structure according to the invention may be a J tube or a boat dock.

As mentioned above, the foundation structure according to the invention is not restricted to lattice structures, which consist of corner posts and framework-like struts that are arranged between the corner posts, but also includes structures in which no distinction can be made between corner post and strud (e.g., "hexabase jacket" or DE 20 2011 101 599 UI, or other openwork load-bearing structures, e.g., tripods). These are no longer called corner posts, rather they are referred to as legs. In the claims, the term "leg" is also used.

The object is also achieved by a method disclosed herein. Advantageous alternative embodiments of the method are also disclosed herein.

BRIEF DESCRIPTION OF THE DRAWINGS

In the following, the invention is explained in detail with reference to several exemplary embodiments the principles of which are shown in the figures. In the drawings.

DETAILED DESCRIPTION OF THE INVENTION

Figure 1:
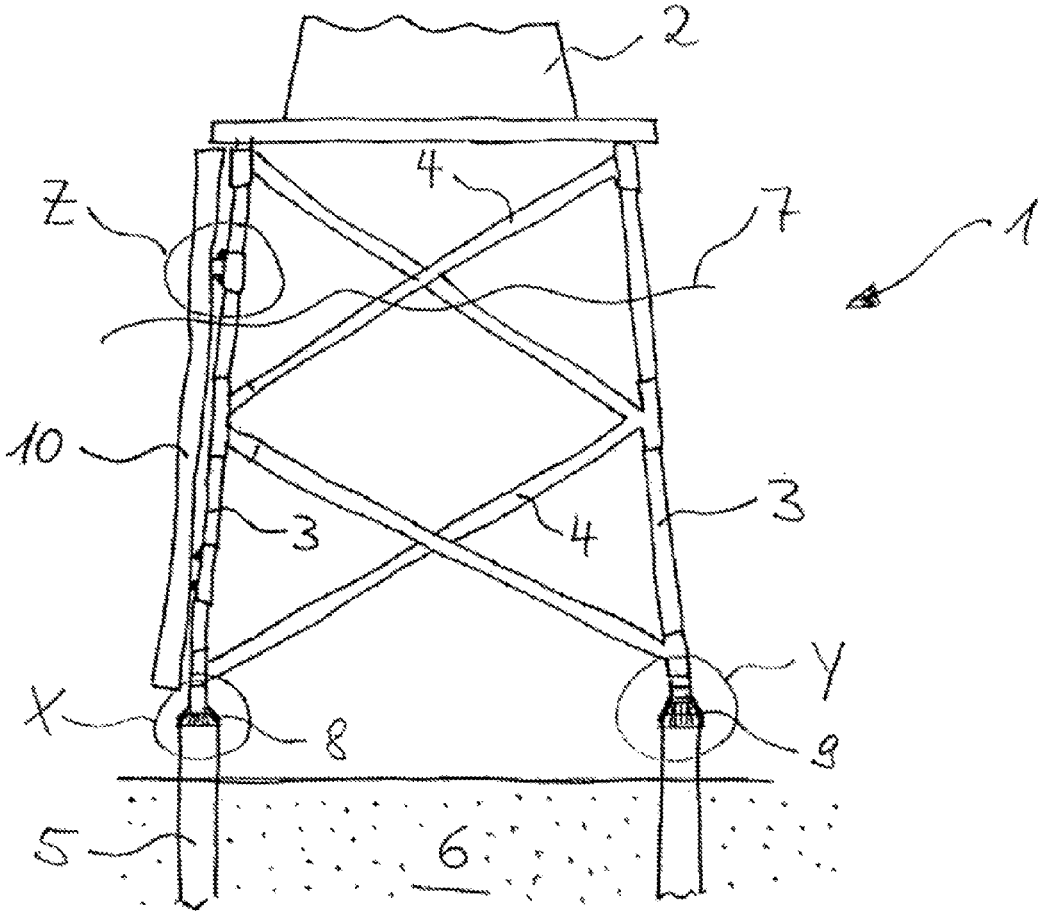
FIG. 1 shows a schematic representation of a foundation structure according to the invention.

FIG. 1 shows a foundation structure 1 for a tower structure 2. This foundation structure 1 is a jacket for an offshore structure such as, for example, for an offshore wind turbine, which means that the jacket is anchored to the sea floor 6, wherein the foundation structure 1 is configured and arranged that its upper part is above sea level 7.

The jacket consists of corner posts 3 and struts 4 which are arranged between the corner posts 3 and secured thereto. These components are load-dissipating parts, which are referred to as primary structures. The corner posts 3 are anchored via hollow foundation piles 5 in seabed 6, wherein the insertion depth of the corner posts 3 in the foundation piles 5 is limited by pile stoppers 8, 9. As will be shown later in detail, FIG. 1 shows two different pile stoppers, namely pile stopper 8 adhesively secured at the left corner post, pile stopper 9 connected by grout at the right corner post.

Figure 2:
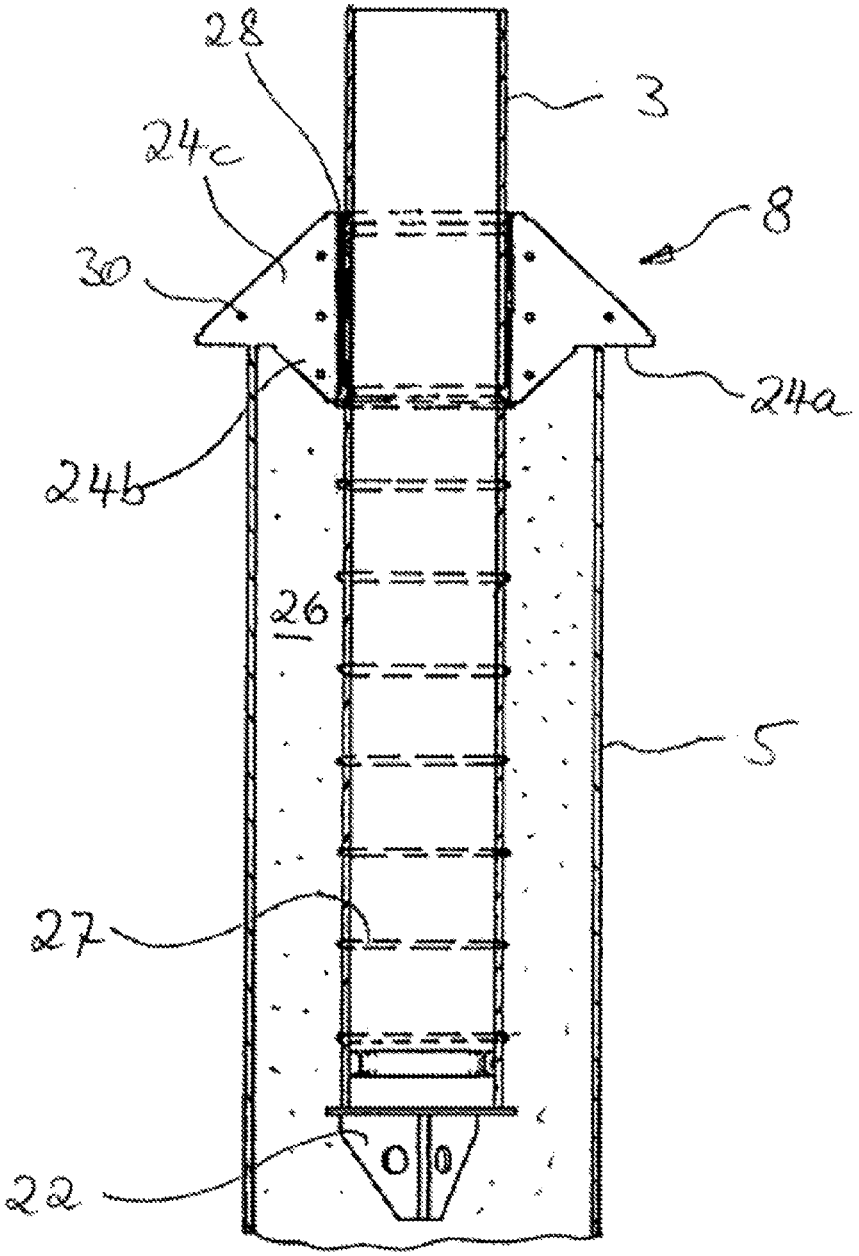
FIG. 2 shows a detailed view of the section designated with X in FIG. 1 of an exemplary embodiment of a bonded pile stopper in sectional view.

FIG. 2 shows the section designated with X in FIG. 1 in enlarged and sectional representation. Shown is a corner post 3 which in a foundation pile 5 that is pre-driven into the seabed is grouted by a grout connection 26 with pile 5. Shear plates 27 are provided at the corner post 3 on the outside of the section entering pile 5. Furthermore, an insertion aid 22 is formed at the lower end of the corner post 3.

A pile stopper 8 is resting on top of foundation pile 5. Pile side, pile stopper 8 has a supporting surface 24*a* via which the pile stopper plate 24 rests on pile 5. It further has reinforcing fins 24*b*, 24*c*, which extend downwardly (24*b*) or upwardly (24*c*) from the pile stopper plate 24. The pile stopper plate 24 is connected to the corner post 3 via an adhesive connection. For the sake of greater clarity the adhesive layer 28 establishing the adhesive connection is shown only in the left part of the pile stopper plate 24.

Figure 3:
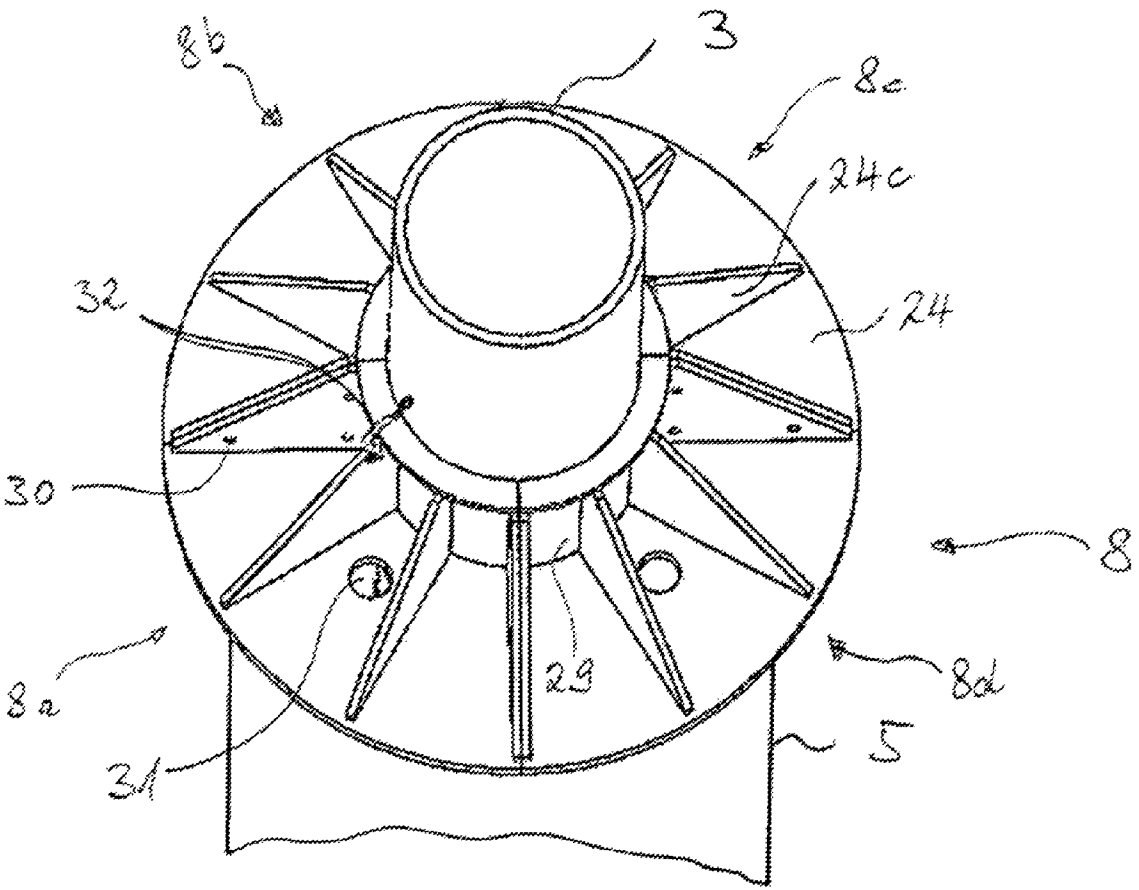
FIG. 3 shows an isometric view of the pile stopper shown in FIG. 2.

FIG. 3 shows in isometric view the detail designated X in FIG. 1 that has already been described with reference to FIG. 2. Pile stopper 8 which is secured to the corner post 3 by means of an adhesive connection consists of a circular ring plate 24 having a central through hole for corner post 3, as can be seen from FIG. 2. This through-hole is sized so that corner post 3 and pile stopper 8 form an intermediate annular gap, in which an adhesive is placed to form an adhesive layer 28. For this annular gap to be formed as uniformly as possible, there are provided spacers in the form of circumferential annular beads on the annular gap side surface of the pile stopper, i.e., on the surface facing corner post 3. After placing the adhesive composition into the annular gap and after curing or setting of the adhesive composition corner post 3 and the pile stopper are connected. Here, the adhesive may be chosen so that the connection still has a certain elasticity, so that pile stopper 8 can still move elastically to some extent in the longitudinal direction of corner post 3.

Ring plate 24 of corner post 3 rests on its bottom 24*a* on foundation piles 5. On the upper side of ring plate 24 a cylindrical sleeve 29 is secured substantially perpendicular to ring plate 24 and stabilized by means of stiffening fins 24*c*. In the exemplary embodiment shown, pile stopper 8 is composed of four 90° ring segments 8*a* to 8*d*. These ring segments 8*a* to 8*d* are bolted together at the pairwise butting interfaces. For this purpose, holes 30 are provided for the passage of bolts in the reinforcing fins 24*c* resting adjacently.

Four holes 31 are provided in ring plate 24 which enable the escape of sea water when filling grout 26 into foundation piles 5 and also allow observation of the pile inside, e.g., by remote-controlled cameras to monitor the gradual filling of pile 5 with grout 26. At least one electrical grounding cable 32 is provided for establishing a conductive contact between corner post 3 and pile stopper 8. Ring plate 24 resting directly on pile 5 ensures a conductive connection between these two components. In addition, however, further grounding can be made by providing an appropriate grounding cable.

Figure 4:
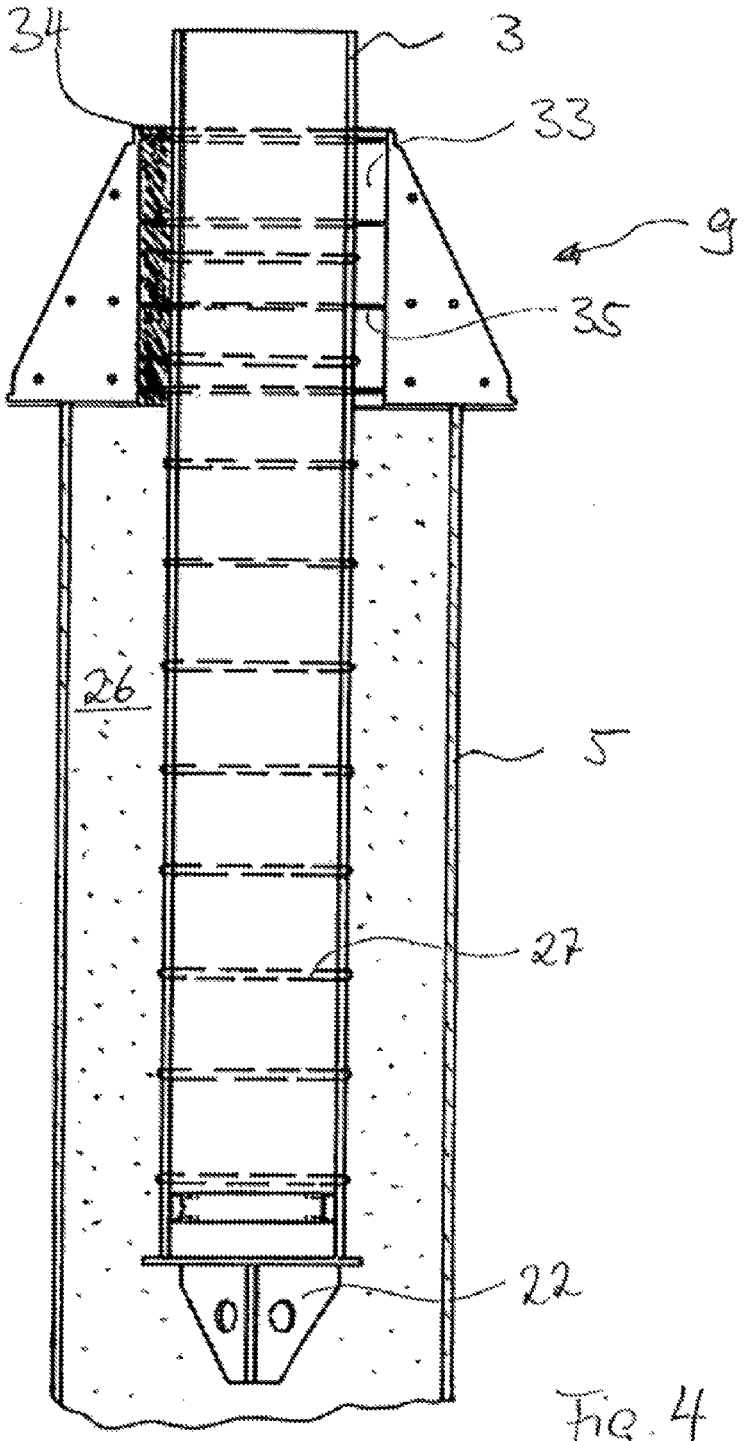
FIG. 4 shows a detailed view of the section designated with Y in FIG. 1 of another exemplary embodiment of a grouted pile stopper.
Figure 5:
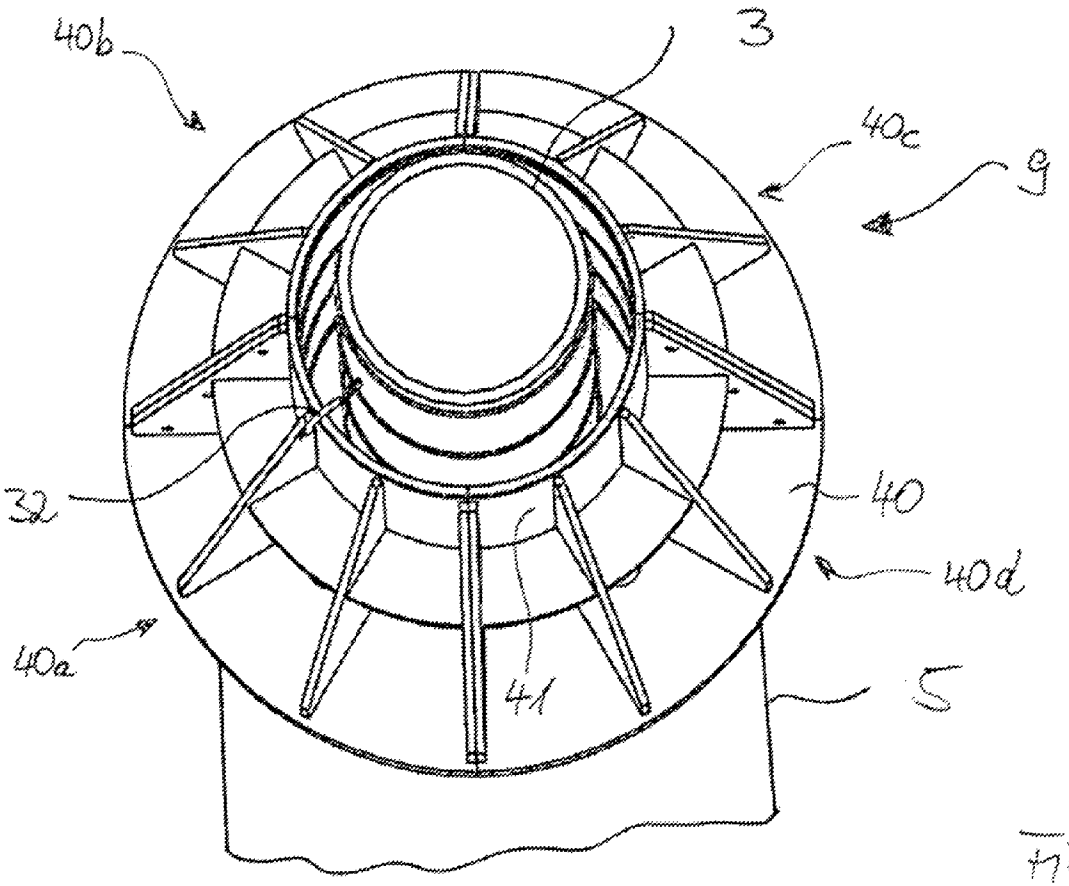
FIG. 5 shows an isometric view of the pile stopper shown in FIG. 4.

FIGS. 4 and 5 show an alternative design of a pile stopper 9. In the sectional view of FIG. 4 it can be seen that annular gap 33 between corner post 3 and pile stopper is significantly larger than that of the adhesive variant. This annular gap 33 is filled with a grout composition to secure pile stopper 9 to corner post 3, and after setting of grout composition 34, there is a strong connection between corner post 3 and pile stopper 9. This connection can be further improved in strength by forming shear plates 35 on the corner post side inner surface of the pile stopper 9. Corner post 3 also has functionally identical shear plates 27 on its end section on the side of the anchoring. These shear plates 35 and 27 allow for a more stable connection with both grout 34 filled into annular gap 33 and with grout 26 filled into pile 5.

Moreover, pile stopper 9 which is connected by the grouting also consists of a base plate 40 and a cylinder 41 arranged perpendicular thereto, which encloses the central opening in base plate 40, and together with corner post 3 forms annular gap 33. Again, a grounding cable 32 is installed between corner post 3 and pile stopper in order to establish an electrically conductive connection. Pile stopper 9 of FIG. 5 also consists of four 90° segments 40*a* to 40*d*, which are secured by bolts to one another to form a 360° pile stopper. However, other segmentations are conceivable, e.g., a subdivision into two, three, or more than four segments. The division into segments is advantageous because it makes handling much easier.

Unlike in the prior art, securing of pile stopper 8 or 9 to corner post 3, can be carried out immediately before securing the lattice tower structure 1 to foundation piles 5. The height up to which the foundation piles 5 protrude from the seabed 6, can be measured and thus the desired height position of pile stoppers 8, 9 at corner post 3 can be determined. In this desired position pile stoppers 8, 9 can be secured to corner post 3 by adhesion (8) or by grouting (9), and after setting of the connection, the lattice tower structure 1 can be lowered onto foundation piles 5, and the lower end 22 of the corner posts 3 (Groutzapfen) inserted in the foundation piles 5 until pile stoppers 8, 9 come to rest on the upper edges of foundation piles 5. In the case of welded joints known from the prior art, a direct establishment of the connection between pile stopper and corner posts at the construction of the tower is not possible, since welds are more complicated to establish. Welds must also be subjected to testing and usually must be accepted by the person issuing the certification. Since adhesive and grout connections usually do not have these disadvantages, the pile stopper can be connected directly to the corner post at the installation site or just prior to loading for shipment at sea, and thus, for example, the use of compensation plates for height adjustment is avoided.

Figure 6:
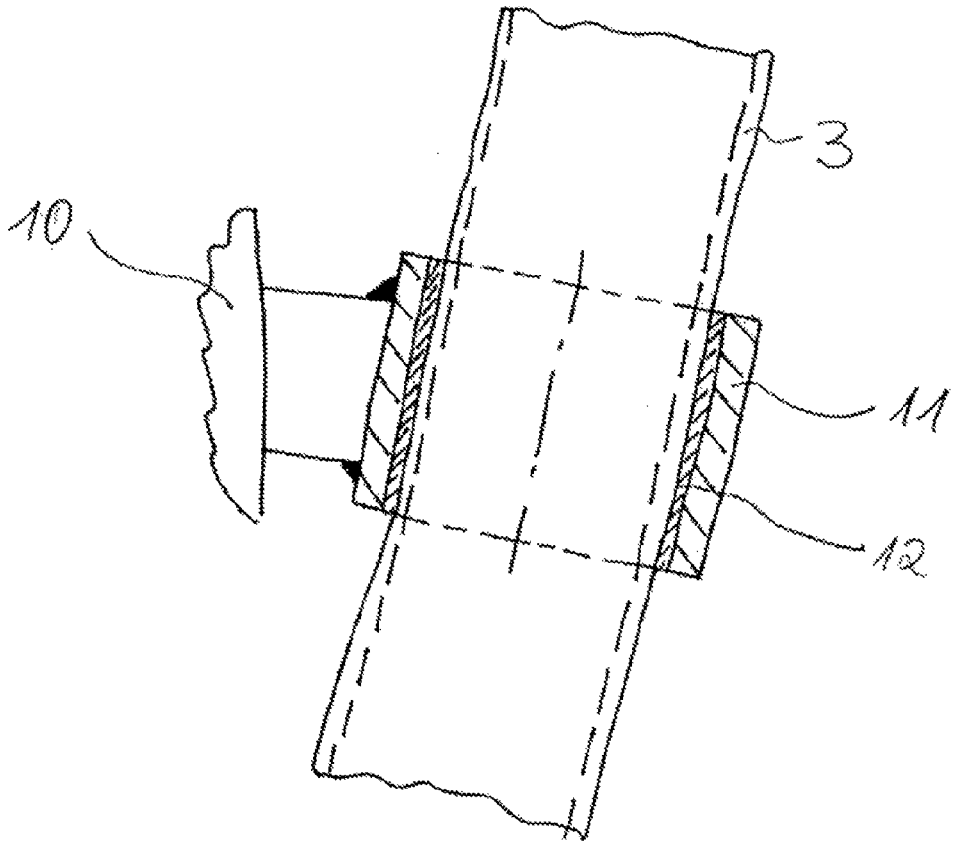
FIG. 6 shows a detail view of the section designated with Z in FIG. 1 of an exemplary embodiment of a connection according to the invention of a secondary structure with a primary structure in sectional view.

FIG. 6 shows an enlarged view of the section designated Z in FIG. 1. It shows the attachment of a J tube 10 to a corner post 3 via a sleeve 11. An annular collar 11 is placed around the tubular corner post 3, with an annular gap remaining between corner post 3 and sleeve 11 which is filled with an adhesive composition 12. After setting of this connecting layer forming adhesive composition 11 there is a fixed connection between sleeve 11 and corner post 3 which does not affect the stability of corner post 3. J tube 10 is welded to sleeve 11.

Sleeve 11 can be composed of multiple subrings. Conceivable are, for example, two 180° subrings, three 120° subrings, or four 90° subrings. Combinations of different subrings are possible, too. It is also possible that sleeve 11 surrounds tubular corner post 3 only at a portion of the circumference, for example, by 90°. The size of the adhesive surface must merely meet the stability requirements for securing the secondary structure. These requirements are less, for example, in case of a J tube 10 compared to a working platform. In case of high stability requirements, therefore, a sleeve 11 surrounding the corner post 3 completely is preferred.

The invention claimed is:

1. An openwork load-bearing structure for a wind turbine, wherein the openwork load-bearing structure comprises:

primary structures via which loads which occur in the load-bearing structure as a result of the wind turbine are dissipated; and secondary structures, which only perform functional tasks and do not dissipate loads which occur in the load-bearing structure as a result of the wind turbine;

wherein the secondary structures are arranged on the primary structures and are connected integrally thereto, wherein the integral connection between the primary structures and the secondary structures is in the form of a connecting layer arranged therebetween, and wherein said openwork load-bearing structure is a foundation structure, wherein one or more of the primary structures is a corner post or a leg, and wherein one or more of the secondary structures is a pile stopper for depth-limiting the corner post or leg when the corner post or leg is inserted into a driven foundation pile.

2. The openwork load-bearing structure according to claim 1, wherein the connecting layer is in the form of an adhesive layer.

3. The openwork load-bearing structure according to claim 1, wherein each of the secondary structures is secured to a sleeve, which positively fits one of the primary structures, and wherein the connecting layer is formed between the sleeve and the primary structure.

4. The openwork load-bearing structure according to claim 3, wherein the sleeve is of multipart design.

5. The openwork load-bearing structure according to claim 3, wherein the primary structure is tubular, and wherein the sleeve is formed as a part-shell.

6. The openwork load-bearing structure according to claim 5, wherein the sleeve together with other sleeves or together with one or more auxiliary shells forms a complete ring.

7. The openwork load-bearing structure according to claim 1, wherein the pile stopper completely encloses the corner post or the leg forming an annular gap, and wherein the connecting layer is arranged in the annular gap.

8. The openwork load-bearing structure according to claim 7, wherein the pile stopper is constructed of several part-annular segments.

9. The openwork load-bearing structure according to claim 1, wherein the pile stopper is constructed of a bottom pile stopper ring plate with a central through hole for the corner post or the leg, a cylindrical extension surrounding the through hole and arranged on the inside of the ring of the pile stopper ring plate, and several reinforcing fins, which are arranged extending radially outwardly between pile stopper ring plate and extension along a perimeter of the extension which is arranged substantially perpendicular on the pile stopper ring plate, and wherein the pile stopper ring plate is sized radially surmounting the foundation pile at the corner post or leg inserted in the foundation pile.

10. The openwork load-bearing structure according to claim 7, wherein spacers are arranged on the annular gap side cylindrical surface of the pile stopper, via which the corner post or the leg are kept at a distance from the pile stopper.

11. The openwork load-bearing structure according to claim 1, the further comprising one or more additional secondary structures selected from the group consisting of J tubes, platforms and docks for landing of boats, and work platforms.

12. A method for producing an openwork load-bearing structure for a wind turbine, wherein the load-bearing structure includes primary structures via which loads which occur in the load-bearing structure as a result of the wind turbine are dissipated, and secondary structures, which only perform functional tasks and do not dissipate loads which occur in the load-bearing structure as a result of the wind turbine, the method comprising integrally connecting at least one primary structure to a secondary structure by arranging a setting connecting layer between the at least one primary structure and the secondary structure, wherein the secondary structure is a pile stopper, and the primary structure is a corner post or leg.

13. The method according to claim 12, wherein the connecting layer is in the form of an adhesive layer.

14. The method according to claim 12, wherein the secondary structure is secured to a sleeve, which positively fits the primary structure, and wherein the connecting layer is formed between sleeve and primary structure.

15. The method according to claim 14, wherein the secondary structure is secured to the sleeve prior to connecting the sleeve to the primary structure.

16. The method according to claim 12, wherein, prior to connecting the pile stopper to the corner post or the leg, a measurement of the pre-driven foundation piles is performed to determine an appropriate location of the pile stopper at the corner post or leg, and wherein the pile stopper is secured at the appropriate location on the corner post or leg as determined by the measurement.

17. The method according to claim 12, wherein connecting devices are arranged in an area of the connecting layer with the use of grout for improving shear stability.

18. The method according to claim 12, wherein the method further comprises integrally connecting at least one primary structure to one or more additional secondary structures by arranging a setting connecting layer between the at least one primary structure and the one or more additional secondary structures, wherein the one or more additional secondary structures are selected from the group consisting of J tubes, platforms and docks for landing of boats, and work platforms.

* * * * *